US009327949B2

(12) United States Patent
Dorzbach

(10) Patent No.: US 9,327,949 B2
(45) Date of Patent: May 3, 2016

(54) JIB-BRACING SYSTEM FOR A REVOLVING TOWER CRANE

(75) Inventor: Ulrich Dorzbach, Heilbronn (DE)

(73) Assignee: WOLFFKRAN HOLDING AG, Zug (CH)

( * ) Notice: Subject to any disclaimer, the term of this patent is extended or adjusted under 35 U.S.C. 154(b) by 231 days.

(21) Appl. No.: 13/995,265

(22) PCT Filed: Dec. 21, 2011

(86) PCT No.: PCT/EP2011/006477

§ 371 (c)(1),
(2), (4) Date: Sep. 23, 2013

(87) PCT Pub. No.: WO2012/084229

PCT Pub. Date: Jun. 28, 2012

(65) Prior Publication Data

US 2014/0001139 A1 Jan. 2, 2014

(30) Foreign Application Priority Data

Dec. 21, 2010 (DE) ..... 10 2010 055 325

(51) Int. Cl.

| | |
|---|---|
| ***B66C 23/02*** | (2006.01) |
| ***B66C 23/82*** | (2006.01) |
| ***B66C 23/26*** | (2006.01) |

(52) U.S. Cl.

CPC ..... *B66C 23/826* (2013.01); *B66C 23/26* (2013.01); *B66C 23/82* (2013.01)

(58) Field of Classification Search

CPC .... B66C 23/82; B66C 23/821; B66C 23/823; B66C 23/825; B66C 23/826; B66C 23/828; B66C 23/26

USPC ..... 212/223

See application file for complete search history.

(56) References Cited

U.S. PATENT DOCUMENTS

| | | | | |
|---|---|---|---|---|
| 5,834,942 | A * | 11/1998 | De Angelis | 324/522 |
| 2004/0245201 | A1 * | 12/2004 | Paschke | 212/298 |

FOREIGN PATENT DOCUMENTS

| | | | |
|---|---|---|---|
| DE | 1531150 | A1 | 12/1969 |
| DE | 103 15 989 | A1 | 11/2004 |
| EP | 1 466 855 | | 10/2004 |
| JP | 10 120371 | | 5/1998 |
| RU | 2 371 374 | | 10/2009 |
| SU | 958 303 | | 9/1982 |
| SU | 998 317 | | 2/1983 |

OTHER PUBLICATIONS

International Search Report issued in application No. PCT/EP2011/006477 on Mar. 26, 2012.

* cited by examiner

*Primary Examiner* — Sang Kim
*Assistant Examiner* — Juan Campos, Jr.
(74) *Attorney, Agent, or Firm* — Foley & Lardner LLP

(57) ABSTRACT

The invention relates to a jib-bracing system for a revolving tower crane, in the case of which the length of a jib (2) and the length of a bracing means (5) for the jib can each be changed. The bracing means comprises at least part of a cable (6) of which one end can be connected to the jib at at least two different fixed points (8, 9) arranged on the jib, wherein a deflecting element (7), over which the cable can be guided, is arranged on the jib, and wherein the one end of the cable can be fastened at at least one of the fixed points when the cable has been guided over the deflecting element.

6 Claims, 2 Drawing Sheets

JIB-BRACING SYSTEM FOR A REVOLVING TOWER CRANE

Figure 1:
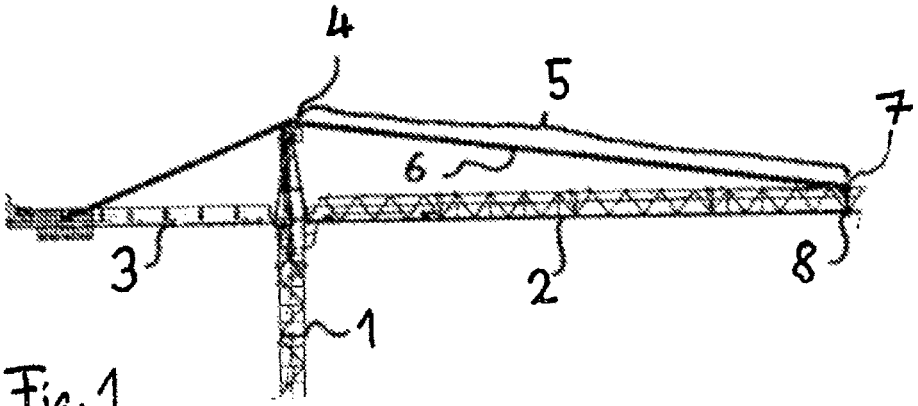

The invention relates to a jib-bracing system which is intended for a revolving tower crane and in which the length of a jib and the length of a bracing means for the jib can each be changed.

Revolving tower cranes comprise a crane base, from which a tower extends upwards. A jib and possibly a counter-jib are fitted on an upper portion of the tower. The jib and counter-jib are connected to the tower, in particular the tower head, by bracing means. In the case of known trolley jib cranes, the one end of the bracing means is fastened on the tower head and the other end of the bracing means is fastened on the jib. In the case of luffing jib tower cranes, the bracing means is connected to the luffing cable at the end which is not connected to the jib, and therefore the jib is retained by the combination of luffing cable and bracing means. Conventional bracing means comprise jib pendants made of steel or steel-wire cable. It is known for bracing means to be made up of a plurality of individual pendants. This has the advantage that the bracing means can be split into smaller parts for transportation. Furthermore, the individual pendants can be used to produce bracing means of different lengths, which are thus suitable for different jib lengths. The disadvantage with this known system is that it comprises a large number of individual parts which have to be organized, transported and assembled individually. Added to this is the fact that the conventional steel bracing means are problematic to handle. Furthermore, the weight of the conventional steel bracing means has an adverse effect on the crane load.

The object of the invention is to provide a jib-bracing system intended for a tower crane and in which the bracing means comprises the smallest possible number of individual parts, but can nevertheless be changed in length.

This object is achieved by a jib-bracing system having the features given in patent claim 1. Further embodiments form the subject matter of the dependent claims or are described hereinbelow.

The solution according to the invention has the advantage that there is no need to have a bracing unit of appropriate length for every necessary length of bracing means. This is economically advantageous and, furthermore, has the advantage that it avoids the problem of safekeeping the bracing units which are not required for the current set-up variant. The solution according to the invention is also advantageous in relation to another conceivable solution in which the cable, in a manner analogous to conventional tube pendants, would be split into pieces in order to obtain different lengths of bracing means by combining pieces of cable, because each piece of cable would require two end connections, which involve high outlay and are therefore particularly cost-intensive. In the case of the solution according to the invention, the aim of making it possible to change the length of the bracing means is achieved without there being any need for a plurality of pieces of cable or other bracing units each with two end connections. The solution according to the invention does away with the need to organize a large number of individual parts and also the time-consuming and labor-intensive task of assembling individual parts.

A plurality of fixed points are provided in the jib depending on the necessary number of different lengths of bracing means. These fixed points are spaced apart from the deflecting pulley and/or deflecting roller by the distance which is necessary in each case to realize the different bracing length.

The bracing means which is advantageously used is a synthetic-fiber cable, e.g. made of Aramid. Such a synthetic-fiber cable has a weight advantage of up to 80% over conventional steel-cable or steel-pendant bracing means. Since the cable is flexible, it can be wound up for transportation.

Figure 2:
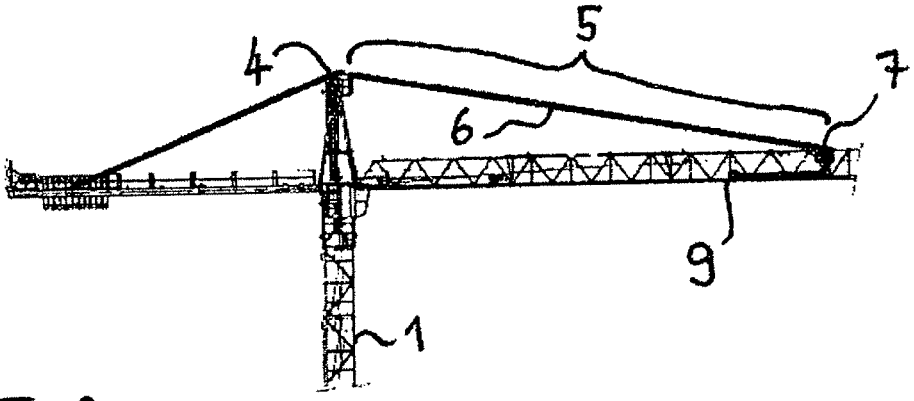
Figure 3:
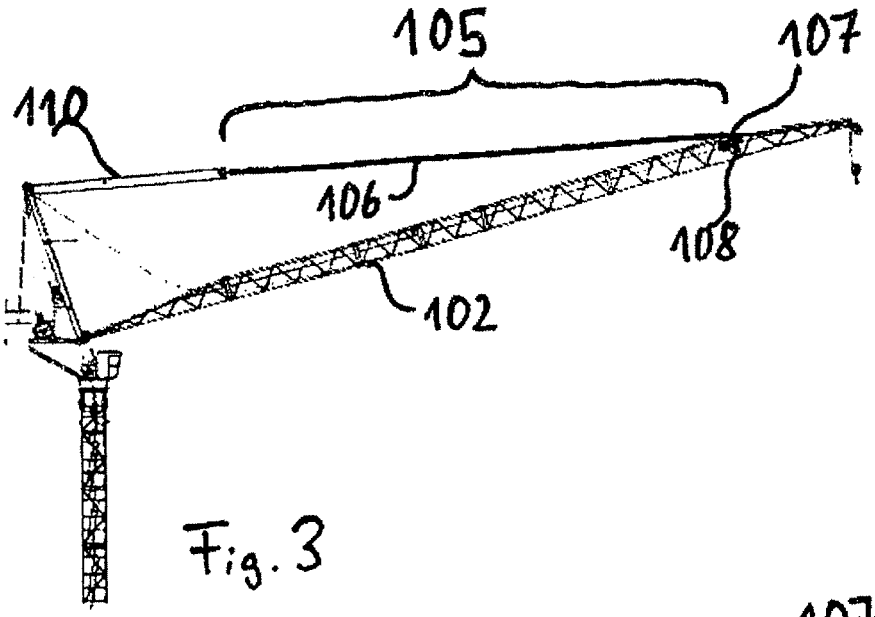
Figure 4:
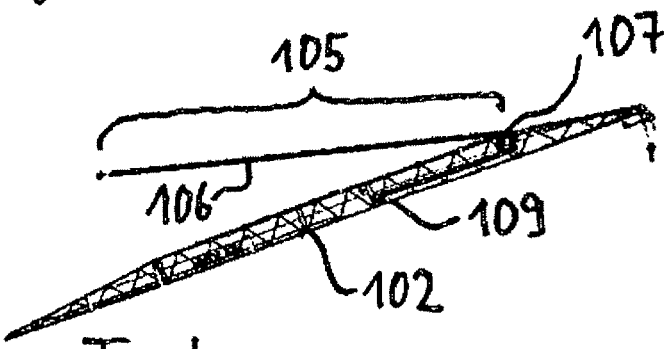
Figure 5:
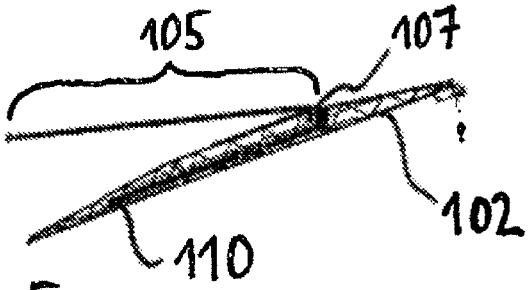

Exemplary embodiments of the invention will be described in more detail hereinbelow and are illustrated in the drawings, in which:

FIG. 1 shows the upper part of a trolley jib crane having a jib-bracing system according to the invention with the bracing means for the jib at maximum length, FIG. 2 shows the upper part of a trolley jib crane having a jib-bracing system according to the invention with the length of the bracing means for the jib shorter than the maximum length, FIG. 3 shows the upper part of a luffing jib tower crane having a jib-bracing system according to the invention with the length of the bracing means for the jib at a maximum, FIG. 4 shows the same jib-bracing system as FIG. 3, with the jib and bracing means shortened, and FIG. 5 shows the same jib-bracing system as FIG. 4, with the jib and bracing means shortened (further).

FIG. 1 illustrates, schematically, part of the upper region of a trolley jib crane. A jib 2 and a counter-jib 3 are fitted on the tower 1. The jib 2 is connected to the tower head 4 by the bracing means 5. The bracing means 5 comprises part of the cable 6, which has been guided over a deflecting roller 7, arranged on the jib 2, and of which the one end is fastened at the fixed point 8. FIG. 2 shows the same jib-bracing system as FIG. 1, with the length of the bracing means 5 shortened in relation to the variant shown in FIG. 1. The one end of the cable 6 has been guided back in the jib, i.e. in the direction of the tower 1, and fastened at the fixed point 9.

FIG. 3 illustrates, schematically, part of the upper region of a luffing jib tower crane. The bracing means 105 is connected to the luffing cable 110, of which the length can be adjusted via a cable-retracting gear. The bracing means 105 comprises part of a cable 106 which has been guided over a deflecting roller 107, arranged on the jib 102, and of which the one end is fastened at the fixed point 108. FIG. 4 shows the same jib-bracing system as FIG. 3, with the bracing means 105 and jib 102 shortened in relation to the variant shown in FIG. 3. The one end of the cable 106 has been guided back in the jib, i.e. in the direction of the tower 101, and fastened at the fixed point 109. FIG. 5 shows a variant with the bracing means 105 and jib 102 shortened (yet further) in relation to the variant shown in FIG. 4. The one end of the cable 106 has been guided back yet further, in comparison with the variants shown in FIG. 4, and fastened at the fixed point 110. Fixed point 110 is further away from the deflecting roller 107 than fixed point 109.

The invention claimed is:

1. A jib-bracing system for a revolving tower crane, comprising:

a jib and a bracing mechanism for the jib, wherein a length of the jib and a length of the bracing mechanism can each be changed, wherein the bracing mechanism comprises at least part of a cable, of which a first end can be connected to the jib at at least two different fixed points arranged on the jib, wherein the two different fixed points comprises a first fixed point and a second fixed point, wherein a deflecting element is attached to the jib, and the cable can be guided over the deflecting element, wherein the length of the jib extends along a lateral direction, wherein the first fixed point and the second fixed point are positioned at two different distances in the lateral direction from the deflecting element, and wherein the first end of the cable can be fastened at at least one of the fixed points when the cable has been guided over the deflecting element.

2. The jib-bracing system as claimed in claim 1, wherein the cable is a synthetic-fiber cable.

3. The jib-bracing system as claimed in claim 2, wherein the synthetic-fiber cable comprises Aramid.

4. The jib-bracing system as claimed in claim 1, wherein the deflecting element is a deflecting roller or a deflecting pulley.

5. The jib-bracing system as claimed in claim 1, wherein a number of fixed points arranged on the jib corresponds to a number of possible different lengths of the bracing mechanism.

6. The jib-bracing system as claimed in claim 1, wherein at least one fixed point at which the first end of the cable can be fastened when the cable is guided over the deflecting element is arranged in a direction of the tower, as seen from the deflecting element.

* * * * *